US006131253A

United States Patent [19]

Jenkins

[11] Patent Number: 6,131,253

[45] Date of Patent: Oct. 17, 2000

[54] FLAT-LID FOR A CASKET

[75] Inventor: Kenneth T. Jenkins, Old Forge, Pa.

[73] Assignee: Chesapeake Packaging Company, Scranton, Pa.

[21] Appl. No.: 09/107,027

[22] Filed: Jun. 29, 1998

Related U.S. Application Data

[62] Division of application No. 08/711,950, Sep. 6, 1996, Pat. No. 5,771,548.

[51] Int. Cl.[7] ..... A61G 17/00

[52] U.S. Cl. ..... 27/14

[58] Field of Search ..... 27/2, 4, 14, 16, 27/19

[56] References Cited

U.S. PATENT DOCUMENTS

| | | | |
|---|---|---|---|
| 2,075,679 | 3/1937 | Weber . | |
| 3,729,786 | 5/1973 | Walding . | |
| 4,156,956 | 6/1979 | Partridge et al. | 27/4 |
| 4,209,880 | 7/1980 | Lidholm . | |
| 4,253,206 | 3/1981 | Cherry . | |
| 4,305,186 | 12/1981 | Cherry . | |
| 4,655,366 | 4/1987 | Sykes . | |
| 4,730,370 | 3/1988 | Elder . | |
| 4,800,631 | 1/1989 | Pellmann . | |
| 4,944,076 | 7/1990 | Kay et al. | 27/14 |
| 5,035,032 | 7/1991 | Nutting . | |
| 5,353,484 | 10/1994 | Woedl et al. | 27/4 |
| 5,454,141 | 10/1995 | Ozbun et al. . | |

OTHER PUBLICATIONS

Statutory Invention Registration No. 1348—Sep. 6, 1994—Linville et al.

*Primary Examiner*—Terry Lee Melius
*Assistant Examiner*—William L. Miller
*Attorney, Agent, or Firm*—Joseph G. Seeber

[57] ABSTRACT

A flat-lid casket has a bottom, two opposing side walls connected to opposing sides of the bottom, and two opposing end walls connected to the opposing end of the bottom and to the two opposing side walls. Each of the two opposing end walls has a main panel, two side flanges, a bottom flange and a top flange. The two side flanges are fixed to the opposing side walls; the bottom flange is fixed to the bottom; and the top flange is folded against and fixed to the main panel. Further features of the casket include side wraps, end wraps and moldings. The main panels are trapezoidal in shape so as to form flared sides for the casket. Adjacent flat surfaces of the casket have mutually perpendicular corrugations for increased strength. The flat lid of the casket has a pair of elongate side members, a pair of elongate end members, a flat cover disposed over the top surfaces of the elongate side and end members, and a flat sheet disposed on the bottom surface of the cover.

6 Claims, 8 Drawing Sheets

FLAT-LID FOR A CASKET

REFERENCE TO RELATED APPLICATION

This is a divisional of Ser. No. 08/711,950 filed on Sep. 6, 1996, now U.S. Pat. No. 5,771,548 issued on Jun. 30, 1998.

TECHNICAL FIELD

The present invention generally relates to a flat-lid casket and method of manufacture. In general, the casket comprises a body having side and end walls and a flat lid. Either a full flat lid or split flat lids are provided.

BACKGROUND ART

In the past, caskets have been primarily used for burial of the deceased. In more modern times, caskets have often been used for cremation of the deceased. As a result of the latter development, corrugated fiberboard is being used more often to provide an economical casket and one which is suitable for cremation.

Nevertheless, for obvious reasons, it is desirable to provide caskets having strength, sturdiness and an aesthetic appearance. This is especially desirable where the casket is to be displayed in a funeral ceremony, and the like. Thus, there is a need in the prior art for the development of caskets which are economical to construct and suitable for cremation, and yet have a sturdy construction and an aesthetic appearance.

DISCLOSURE OF THE INVENTION

The present invention generally relates to a flat-lid casket and method of manufacture, and more particularly to a casket and method of manufacture wherein side and end walls and a flat lid arrangement are provided.

In one embodiment of the invention, a single, flat lid is provided. In another embodiment of the invention, a flat, split-lid covering is provided. Other features of the invention include: an end panel arrangement at each end of the casket; provision of a liner within the main body of the casket; a uniquely constructed flat lid or lids for the casket; and provision of side and end wraps and moldings.

The outside covering of the casket is a high-grade, printed liner having a wood grain, floral or marble pattern appearance. Preferably, the outside covering is moisture-resistant, and gives the finished casket the appearance of a traditional wood, steel or cloth-covered casket.

In accordance with the invention, the casket is constructed mostly of corrugated fiberboard. Wherever possible, for the sake of economy and to facilitate cremation, the casket is constructed by gluing the various component pieces together. However, in order to provide strength and rigidity to the resultant casket, adjacent panels or surfaces throughout the casket generally have mutually perpendicular corrugations.

Therefore, it is a primary object of the present invention to provide a flat-lid casket and method of manufacture.

It is an additional object of the present invention to provide a casket having side and end walls and a single flat lid.

It is an additional object of the present invention to provide a casket having side and end walls and a flat, split-lid covering.

It is an additional object of the present invention to provide a casket having a unique end panel construction.

It is an additional object of the present invention to provide a casket which, by virtue of the materials from which it is fabricated, is amenable to cremation.

It is an additional object of the present invention to provide a casket having an aesthetic appearance.

It is an additional object of the present invention to provide a casket having strength and rigidity.

The above and other objects, and the nature of the invention, will be more clearly understood by reference to the following detailed description, the associated drawings, and the appended claims.

BEST MODE FOR CARRYING OUT THE INVENTION

The invention will now be described in more detail with reference to the various figures of the drawings.

It should be noted that corrugated fiberboard is a structure formed by gluing one or more sheets of fluted corrugated medium to one or more flat facings of linerboard. Two of the most common types of corrugated fiberboard are employed in the present invention. Single-wall corrugated fiberboard comprises two flat facings of linerboard, one glued to each side of a fluted sheet of corrugated medium. Double-wall corrugated fiberboard comprises three flat facings of linerboard with two interleaved and glued sheets of fluted corrugated medium. For the purposes of this description, the term "quad-wall" will refer to two sheets of double-wall corrugated fiberboard glued together so that the corrugation of one sheet is perpendicular to the corrugation of the other sheet. Finally, in the present description, the adjective "preprintedw" is used to denote a flat facing of linerboard that is printed before being glued to the corrugated medium.

Figure 1:
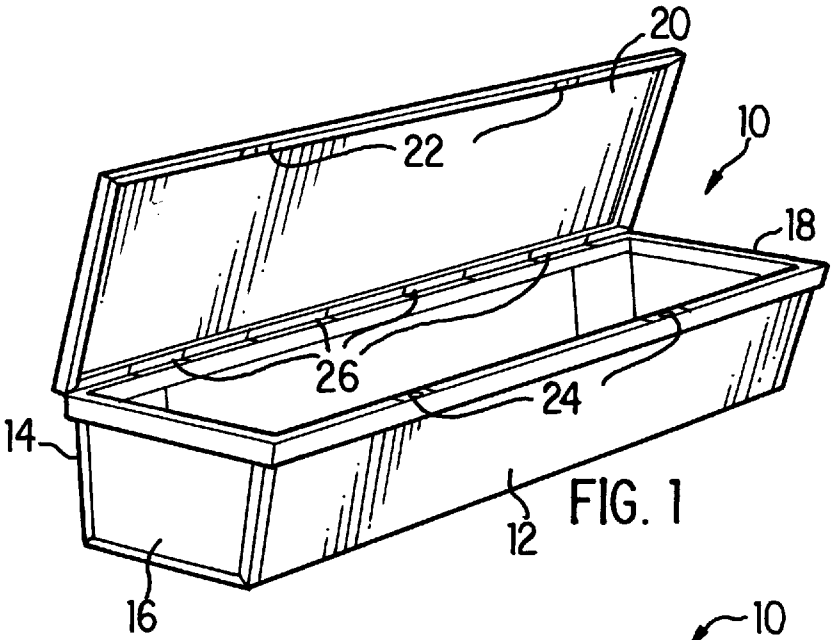
FIG. 1 is a perspective view of a flat-lid casket in the opened condition.
Figure 2:
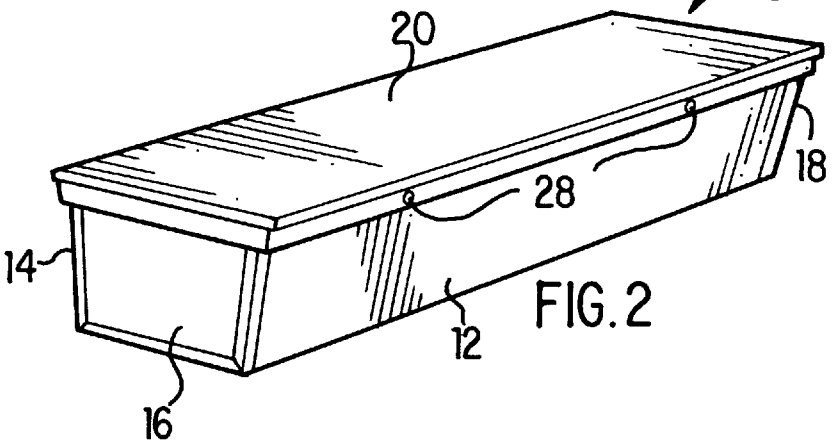
FIG. 2 is a perspective view of a flat-lid casket in the closed condition.

FIG. 1 is a perspective view of a flat-lid casket in the opened condition, while FIG. 2 is a perspective view of a flat-lid casket in the closed condition.

As seen in FIGS. 1 and 2, the casket 10 comprises side walls 12 and 14, end wall 16 and 18, and lid 20 having metal latch mechanisms 22. Side wall 12 is provided with corresponding metal latch mechanism 24, while the lid 20 is connected to side wall 14 via corrugated hinges 26. As seen in FIG. 2, the lid 20 is also provided with metal thumb latches 28 for ease in opening the closed casket 10 of FIG. 2. Preferably, side walls 12 and 14 are flared.

Figure 3:
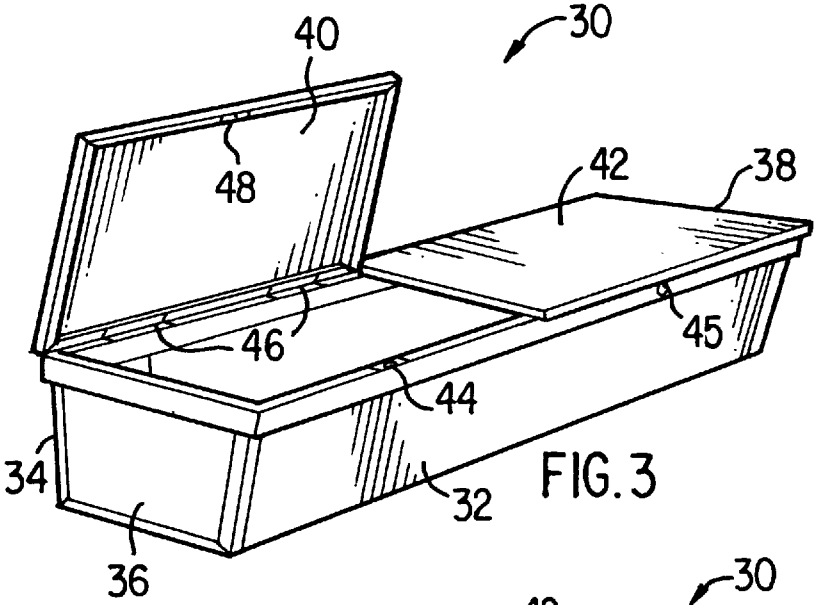
FIG. 3 is a perspective view of a split-lid casket in the opened condition.
Figure 4:
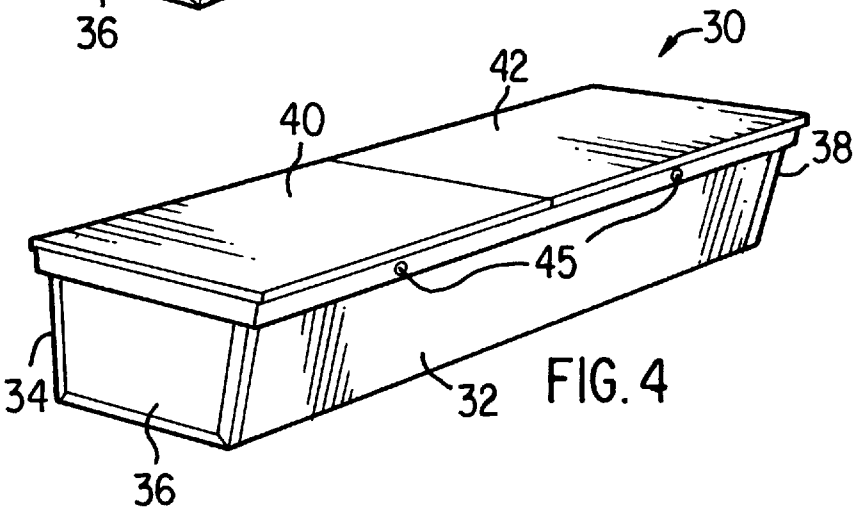
FIG. 4 is a perspective view of a split-lid casket in the closed condition.

FIG. 3 is a perspective view of a split-lid casket in the opened condition, while FIG. 4 is a perspective view of a split-lid casket in the closed condition.

As seen in FIGS. 3 and 4, the casket 30 comprises side walls 32 and 34, end walls 36 and 38, and split flat lids 40 and 42. Side wall 32 is provided with a metal latch mechanism 44 for lid 40 and a further metal latch. mechanism (not shown) for lid 42. Side wall 32 is also provided with a metal thumb latch 45 for lid 42 and a further metal thumb latch (not shown) for lid 40 so as to provide for ease in opening the lids 40 and 42 when the casket 30 is in the closed condition (see FIG. 4). Finally, lid 40 is provided with a metal latch mechanism 48 corresponding to the metal latch mechanism 44 in the side wall 32, and the same is provided (but not shown) for lid 42. Preferably, side walls 32 and 34 are flared.

Figure 5:
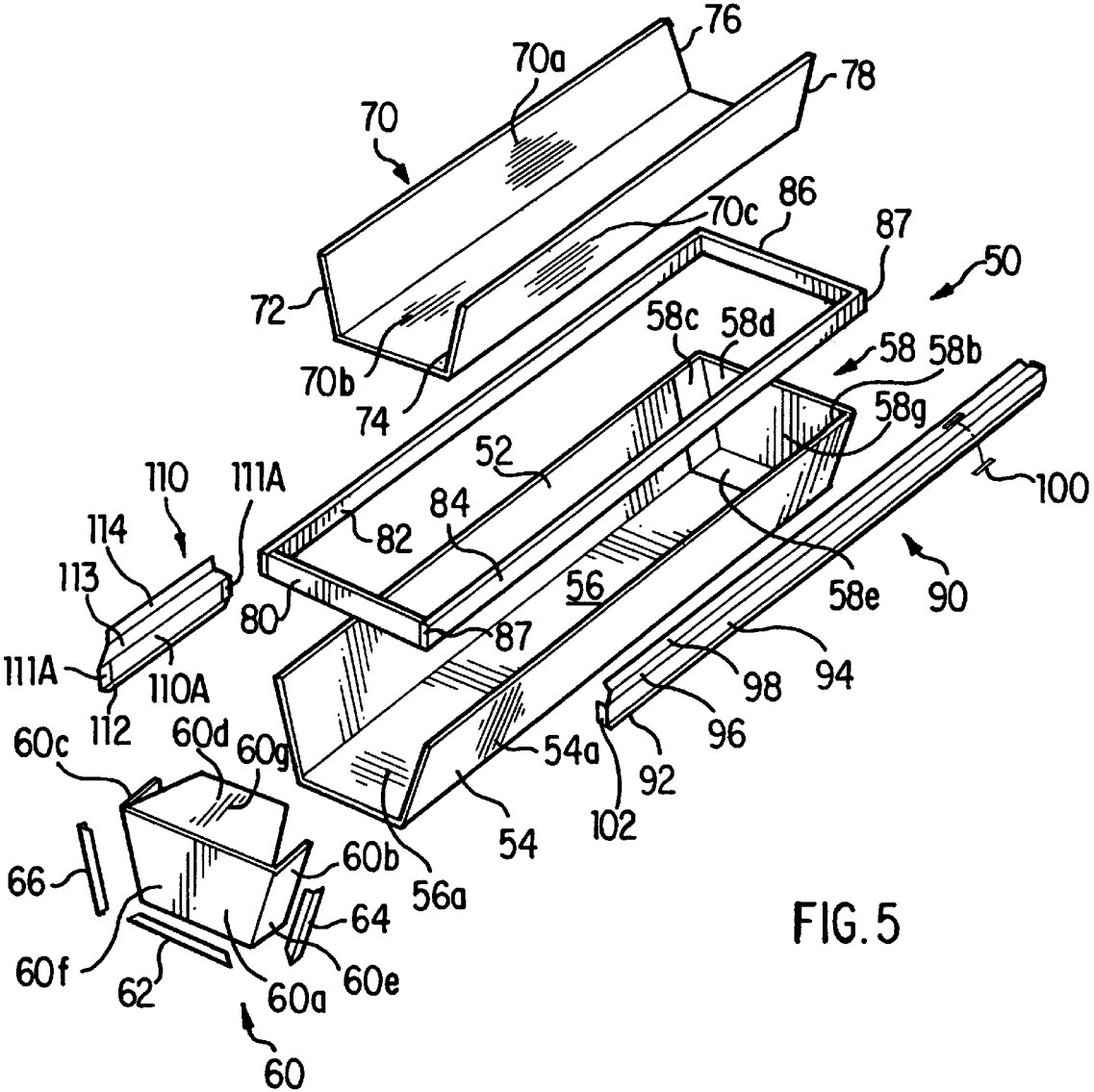
FIG. 5 is an exploded view of various components of the casket of the present invention.

FIG. 5 is an exploded view of various components of the casket of the present invention.

As seen therein, the body 50 of the casket of the present invention comprises a scored sheet of preprinted, double-wall, corrugated fiberboard which forms the exterior surface of the casket body visible in FIGS. 1–4. Specifically, side walls 52 and 54 of the body 50 of FIG. 5 appear, in FIGS. 1–4, as the long flared side walls 12, 14 (FIGS. 1 and 2) and 32, 34 (FIGS. 3 and 4). Preferably, vertical corrugations 52*a* and 54*a* are provided in the sides 52 and 54, respectively, while further corrugation 56*a* runs laterally across the bottom 56 of the body 50.

The ends 58 and 60 of the body 50 are die-cut, preprinted sheets of double-wall corrugated fiberboard. Ends 58 and 60 have main panels (such as panel 60*a* in FIG. 5) forming the exposed end of the casket body (end wall 16, 18 in FIGS. 1 and 2 and end walls 36, 38 in FIGS. 3 and 4).

Figure 6:
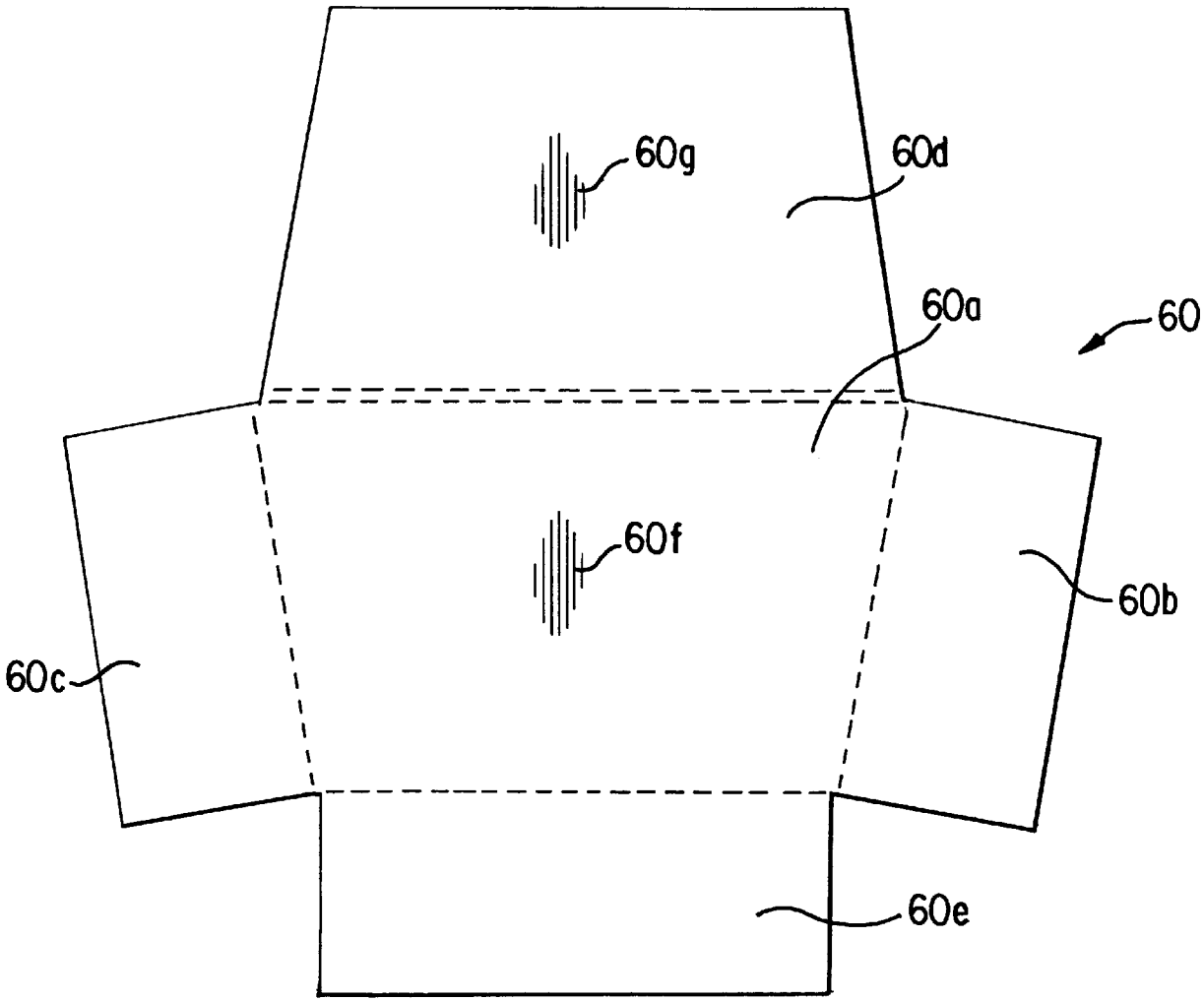
FIG. 6 is a plan view of a cut blank of corrugated fiberboard forming the ends of the casket of the present invention.

The description of the composition of body 50 will continue with reference to FIG. 6, which is a plan view of a cut blank of corrugated fiberboard forming the ends of the casket of the present invention. As seen in FIGS. 5 and 6, the ends 58 and 60 of body 50 have bottom gluing flanges 58*e* and 60*e*, two side gluing flanges 58*b*, 58*c* and 60*b*, 60*c*, and single reinforcing flanges 58*d* and 60*d*. The bottom gluing flanges 58*e* and 60*e* are glued to the interior of the middle panel 56 (see FIG. 5). The side gluing flanges 58*b* and 60*b* are glued to the interior of side panel 54, while side gluing flanges 58*c* and 60*c* are glued to the interior of side panel 52. Preferably, the main panel (not shown) of end 58 and main panel 60*a* are trapezoidal in shape so that flared sides of the casket body 50 are formed in accordance with the present invention. Reinforcing flanges 58*d* and 60*d* are lowered and glued to the interior surface of panels 58*a* and 60*a*, respectively, to form the ends 58 and 60 of the body 50.

Figure 11:
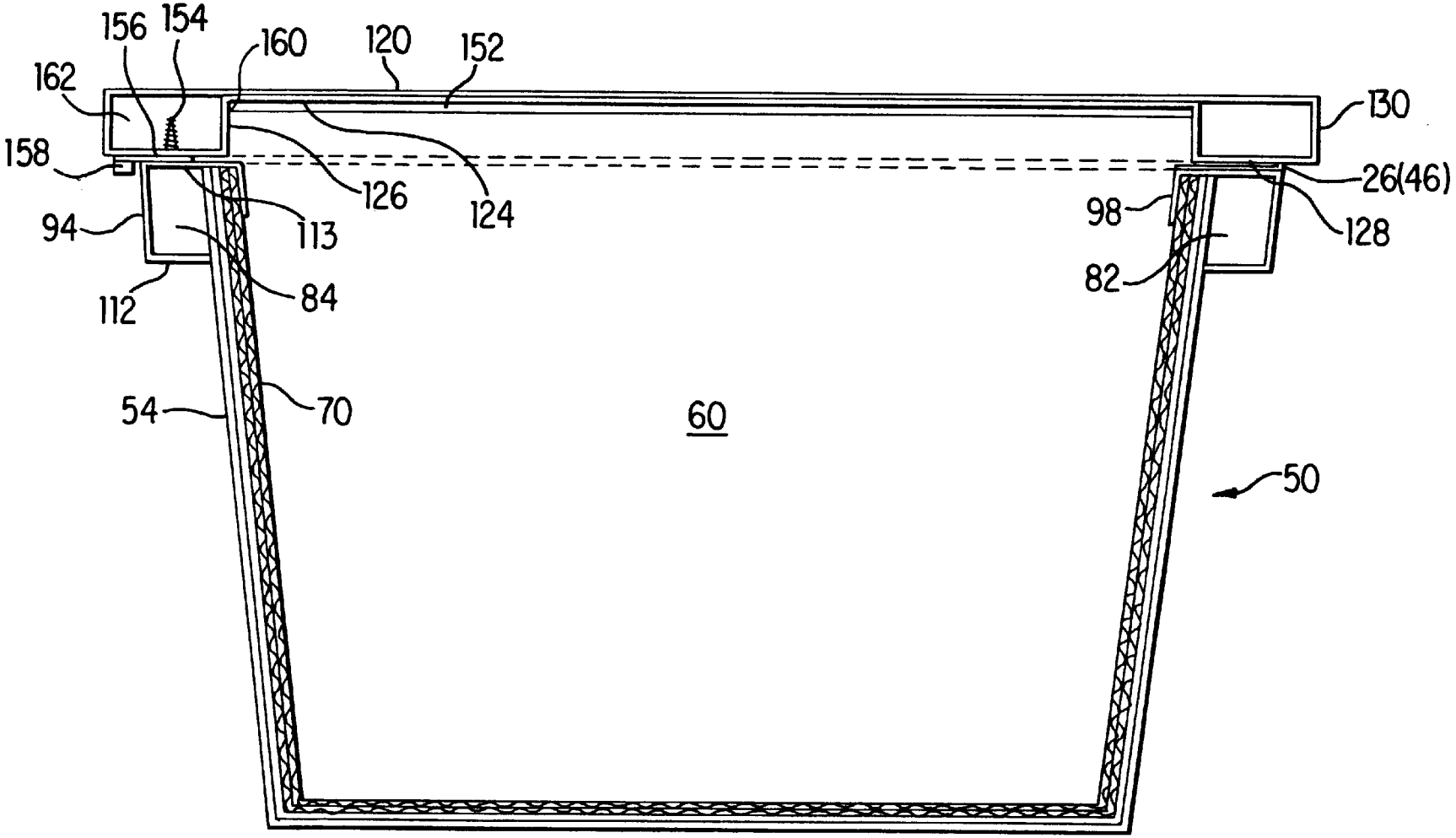
FIG. 11 is a mid-sectional view of the assembled casket of the present invention.

Further referring to FIG. 5, the liner 70 is a scored kraft sheet of double-wall corrugated fiberboard with the corrugations 70*a*, 70*b* and 70*c* running longitudinally along the liner 70. Liner 70 is glued to the interior of body 52 of the casket 50, as illustrated in FIGS. 5 and 11. More specifically, liner 70 is glued in such a position that the edges 72, 74, 76 and 78 of the liner 70 abut against the edges of flanges 60*c*, 60*b*, 58*c* and 58*b*, respectively, of the end panels 60 and 58, respectively. The latter arrangement completes the quad-wall structure of the casket body 50, as illustrated in FIG. 11, and provides corrugation strength both laterally and longitudinally along the sides 52 and 54 and bottom 56 of the casket body 50 (FIG. 5).

The flared wood pieces 80, 82, 84 and 86 in FIG. 5 are joined with metal staples 87 to form a frame which is glued around the top of the exterior of the panels 52 and 54 and the exterior of end panels 58 and 60 of casket body 50 (see FIGS. 5 and 11). The finished product resulting from the employment of the flared wood pieces 80, 82, 84 and 86 can be seen in the perspective views of FIGS. 1–4. Wood pieces 80, 82, 84 and 86 are identical and are differentiated in the drawing figures so as to distinguish the back from the front of the casket body 50. Moreover, pieces 80, 82, 84 and 86 are flared and/or mitered to match the flaring of the panels 52, 54, 58 and 60 of the body 50.

Figure 7:
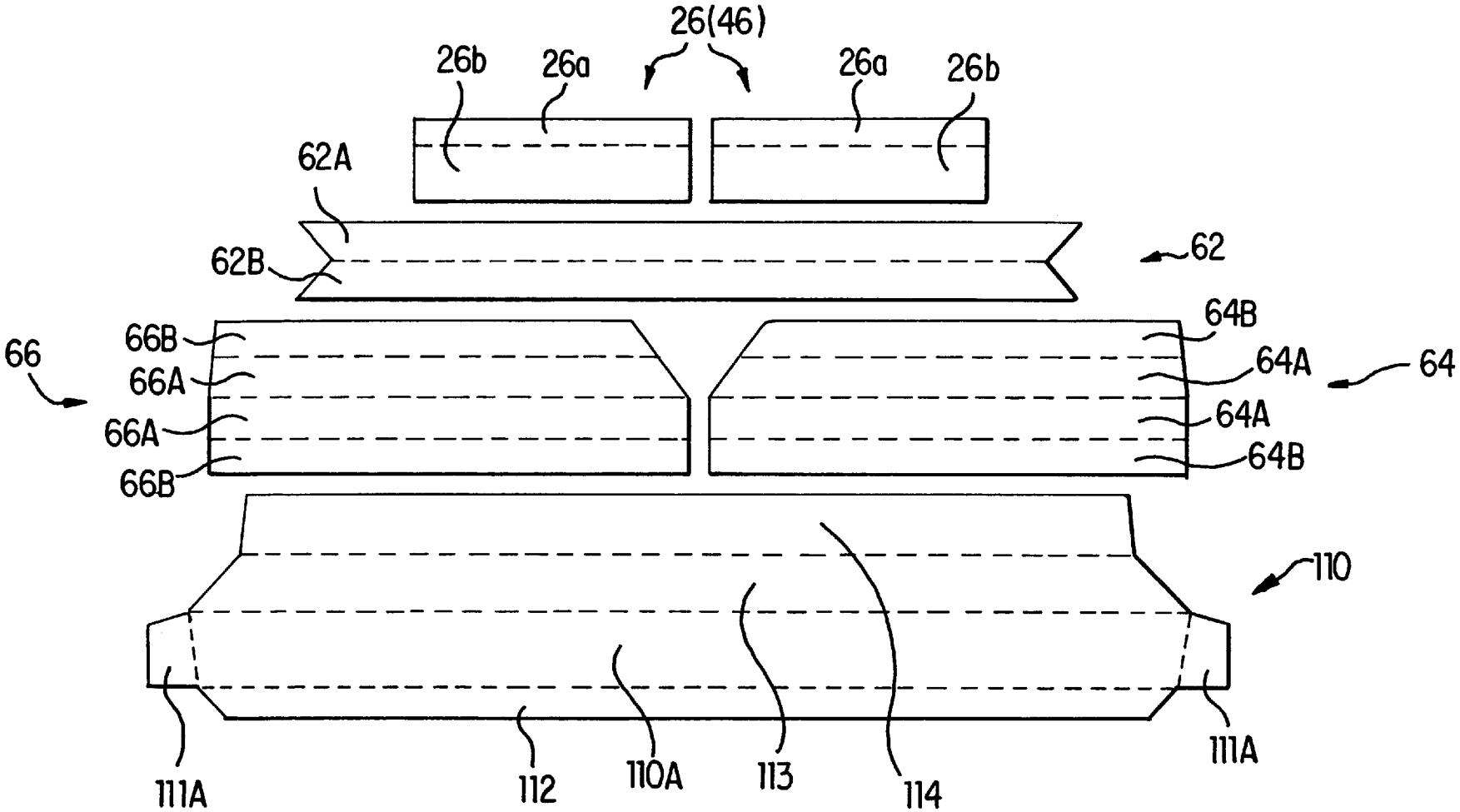
FIG. 7 is a plan view of a cut blank of corrugated fiberboard for forming the end wraps, molding and hinges of the casket of the present invention.

FIG. 7 is a plan view of a cut blank of corrugated fiberboard for forming the end wraps, molding and hinges of the casket of the present invention. As seen therein, hinges 26, 46 are scored sheets of single-wall corrugated fiberboard. Moldings 64, 66 and end wraps 110 are cut and scored from a single sheet of preprinted, single-wall corrugated fiberboard.

Further referring to FIG. 7, end wraps 110 are scored and die-cut sheets of preprinted, single-wall corrugated fiberboard, and are prefolded for ease of assembly. Tabs 111A of end wraps 110 are folded and glued to the back of the panels 110A (see FIGS. 5 and 7), and this folding eliminates an exposed edge of the corrugated fiberboard. The panels 112 of end wraps 110 are glued to the underside of wood end pieces 80 and 86 (FIG. 5), and are positioned to abut the panel 92 of side wraps 90 (FIG. 5).

Figure 8:
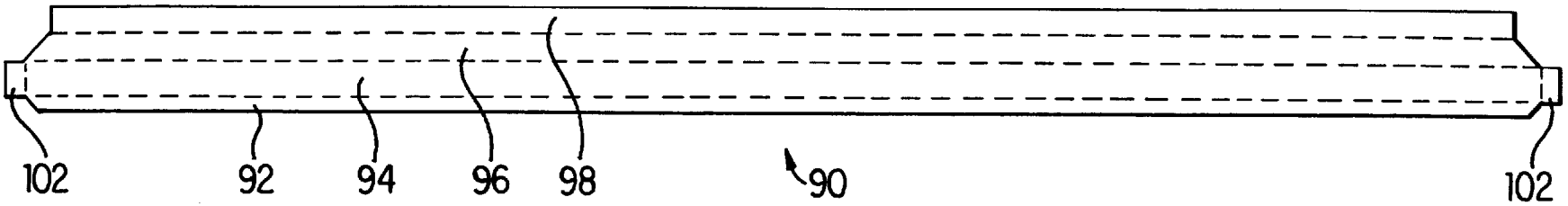
FIG. 8 is a plan view of a cut blank of corrugated fiberboard for forming the side wraps of the casket of the present invention.

FIG. 8 is a plan view of a cut blank of corrugated fiberboard for forming the side wraps of the casket of the present invention. As seen in FIG. 8, side wraps 90 are scored and die-cut sheets of preprinted, single-wall corrugated fiberboard, and are prefolded along the score lines shown (as dotted lines) in FIG. 8.

In assembling the casket body 50 of FIGS. 5 and 11, the side wraps are flipped upright into the position illustrated in FIG. 5. Lowermost panels 92 of side wraps 90 (FIGS. 5 and 8) are glued to the bottom faces of wood pieces 82 and 84. Panels 94 of side wraps 90 are glued to the exterior faces of the wood pieces 82 and 84. The panels 96 of side wraps 90 are glued to the top faces of wood pieces 82 and 84, and the panels 98 of side wraps 90 are wrapped and glued to the interior of the liner 70 and to the flanges 58*b*, 58*c* and 60*b*, 60*c* of end panels 58 and 60, respectively. Tabs 102 of side wraps 90 are glued to the ends of the wood pieces 82 and 84.

Further referring to FIGS. 5 and 7, the exposed portions of the panels 110A and prefixed tabs 111A of end wraps 110 are glued to the exterior face of the wood end pieces 80 and 86 and to previously glued tabs 102 of side wraps 90. The panels 113 of end wraps 110 are glued to the tops of wood pieces 80 and 86, and to the top end portions of wood pieces 82 and 84, in a position abutting panels 96 of side wraps 90. Panels 114 of end wraps 110 are glued to the reinforcing flanges 60*d* of end panels 60.

Moldings 64 and 66 are die-cut, scored sheets of preprinted single-wall corrugated fiberboard. The panels 64B are folded and glued to the panels 64A, leaving the preprinted liner of moldings 64 exposed. Panels 66B are folded and glued to the panels 66A, leaving the preprinted liner of moldings 66 exposed. The folded moldings 64 and 66 are glued to the joints formed by the folding of the flanges 58*b* and 58*c* of end panel 58 and flanges 60*b* and 60*c* of end panel 60, and by the adherence of the flanges 58*b*, 58*c*, 60*b* and 60*c* to the interior of the panels 52 and 54 of the body 50. The die-cut edges of the moldings 64 and 66 form mitered top edges to abut against the underside of the covered joint of the wood end pieces 80 and 86 and the wood side pieces 82 and 84, and abut against the moldings 62 (FIGS. 5 and 7). Moreover, the moldings 64 and 66 cover the exposed corrugated edges of the panels 52 and 54 of the body 50 and the exposed edges of the moldings 62.

The moldings 62 are die-cut, scored sheets of preprinted single-wall corrugated fiberboard which are prefolded for ease of gluing. The moldings 62 are shown in detail in FIG. 7, and the scoring of the moldings 62 is evident in that figure. Moreover, the folding of the moldings 62 is illustrated in FIGS. 1–5. Panels 62A are folded and glued to the panel 62B, leaving the preprinted liner of the moldings 62 exposed. The pre-glued moldings 62 are glued to the bottom of the main panels 58*a* and 60*a*. The die-cut ends of the moldings 62 form a mitered joint that abuts against the moldings 64 and 66. Moldings 62 cover the exposed corrugated edges of the panel 56 of the body 50, and the die-cut edges form a mitered end to abut moldings 64 and 66.

Referring to FIG. 5, strikers 100 are screwed through the panels 96 of side wraps 90 and into wood pieces 82 and 84. Strikers 100 are received in striker plates 156 (FIG. 10) mounted in the lid 150, and are designated as metal latch mechanisms 24 and 44 in FIGS. 1 and 3, respectively. Striker plates 156 (FIG. 10) in lid 150 correspond to metal latch mechanisms 22 and 48 in FIGS. 1 and 3, respectively.

Figure 9:
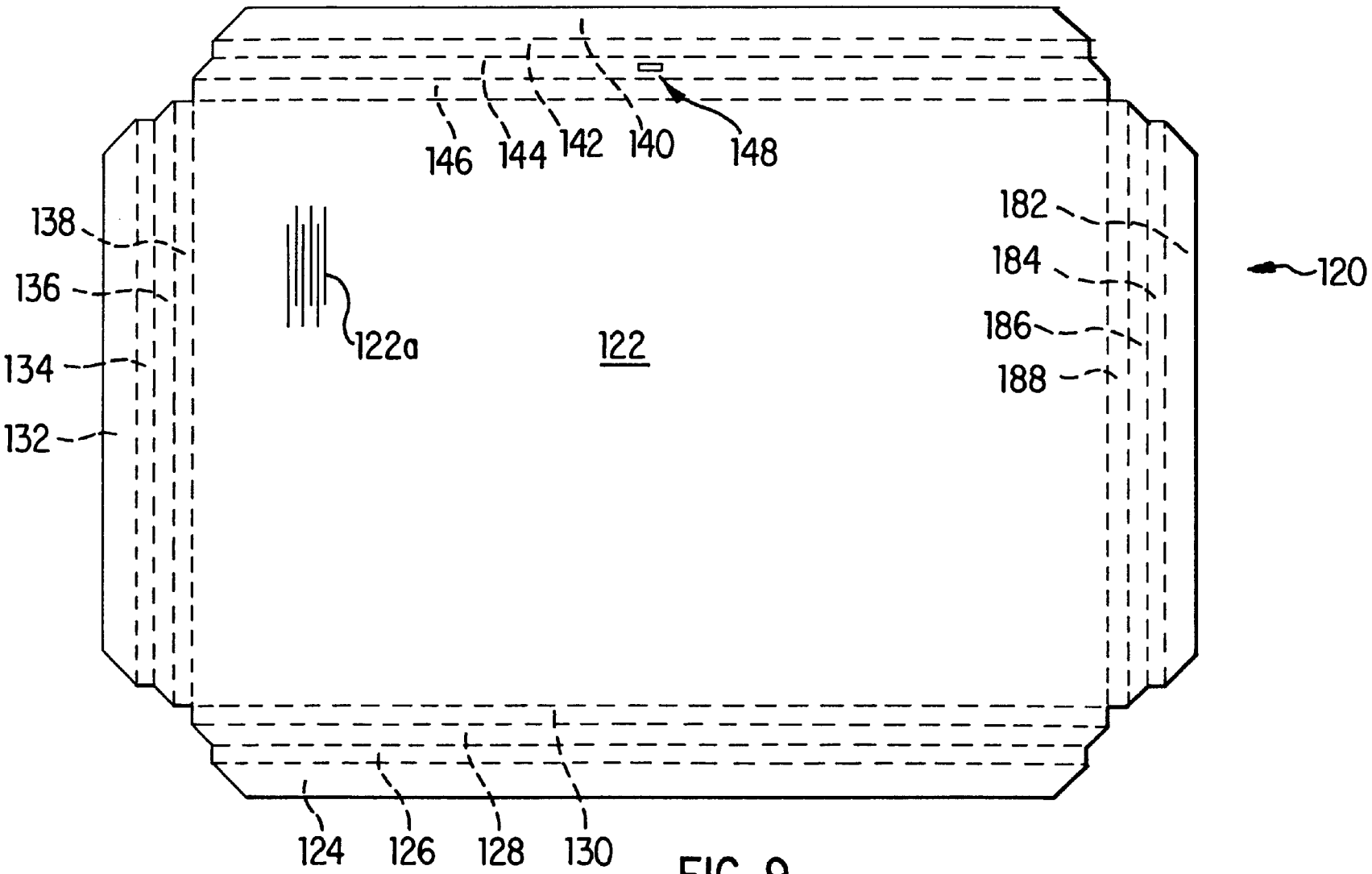
FIG. 9 is a plan view of the cut blank of corrugated fiberboard for forming the lid of the casket of the present invention.
Figure 10:
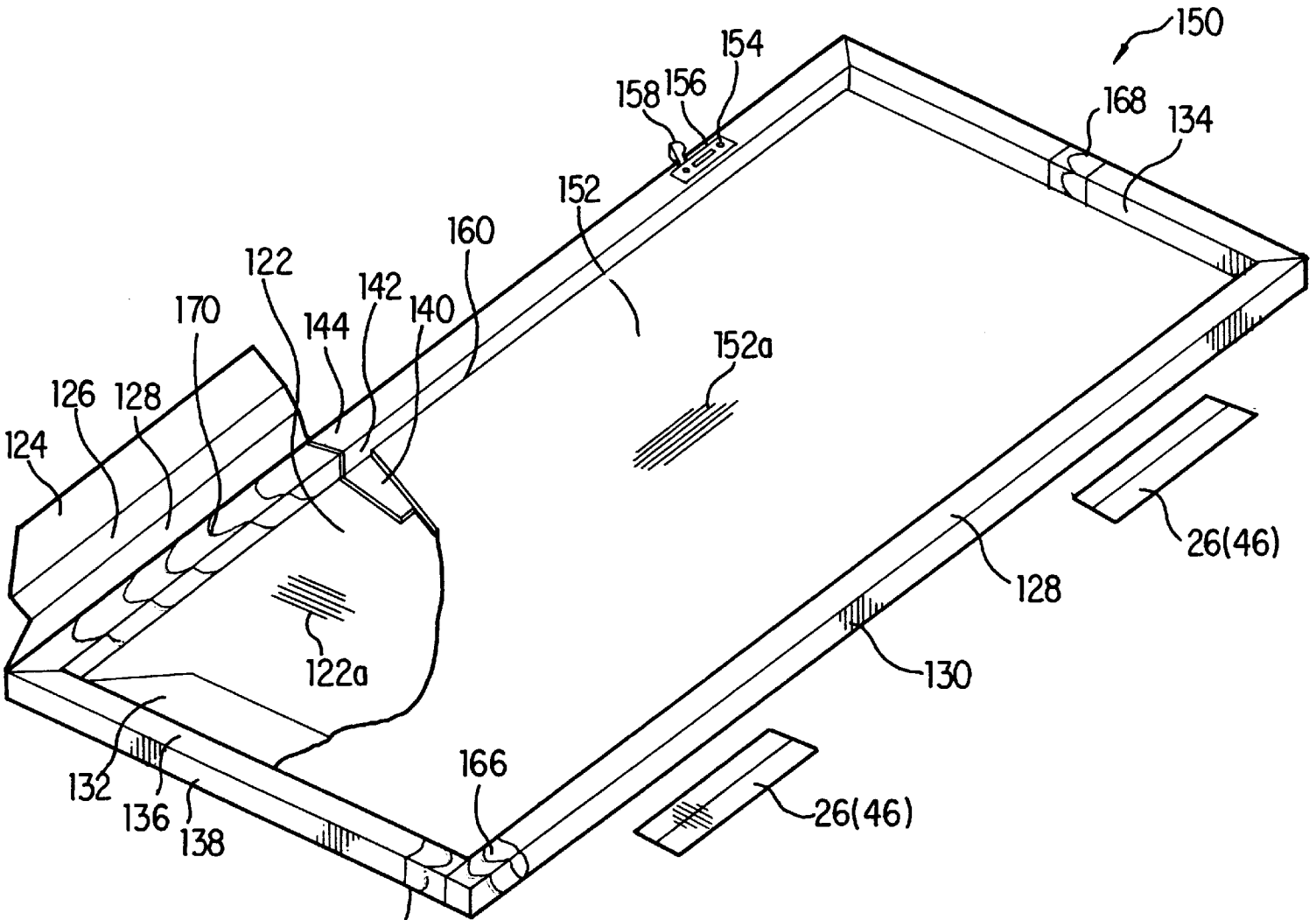
FIG. 10 is a composite view of the assembled casket lid of the present invention.

FIG. 9 is a plan view of the cut blank of corrugated fiberboard for forming a cover portion of the lid of the casket of the present invention, while FIG. 10 is a composite view of the assembled lid of the present invention. More specifically, FIG. 9 details the scored and die-cut preprinted single-wall corrugated fiberboard cover 120 of the present invention, while FIG. 10 illustrates all parts of the assembled lid 150 of the present invention.

As seen in FIG. 9, the cover 120 comprises main panel 122 and side panels 124, 126, 128 and 130 which are used to cover wood pieces 164, 166, 168 and 170 of the lid 150 (FIG. 10). In the latter regard, the wood pieces 164, 166, 168 and 170 are identical, and are only differentiated in FIG. 10 to identify the back, front and sides of the wood frame portion of the lid 150.

As seen in FIG. 10, the fiberboard cover 120 is laterally corrugated (see corrugation lines 122*a* in FIGS. 9 and 10). Wood pieces 164, 166, 168 and 170 are joined with metal staples (not shown). The joined wood pieces 164, 166, 168 and 170 are glued to the inside (the non-preprinted side) of the cover 120 and around the inside perimeter of the cover 120. Thus, FIG. 10 is a perspective view of the bottom or inside of the assembled casket lid 150.

The panel 130 of cover 120 (FIGS. 9 and 10) is glued to the exterior face of the wood piece 166. The panel 128 is glued to the bottom face of the wood piece 166. The panel 126 is glued to the interior face of the wood piece 166. Finally, the panel 124 is glued to the interior surface of the main panel 122 (FIG. 9) on the perimeter formed inside placement of the wood piece 164.

The panel 146 of cover 120 (FIG. 9) is glued to exterior face of the wood piece 170 of FIG. 10. The panel 144 of FIG. 9 is glued to the bottom face of the wood piece 70 of FIG. 10. The panel 142 of FIG. 9 is glued to the interior face of the wood piece 170. Finally, the panel 140 of FIG. 9 is glued to the interior surface of the panel 122 on the perimeter formed inside the placement of the wood piece 170.

The panel 138 is glued to the exterior face of wood piece 164 and to the ends of the wood pieces 166 and 170 so that the panel 138 abuts the panels 130 and 146 of FIG. 9. The panel 136 is glued to the bottom face of the wood piece 164 and to the bottom faces of the ends of wood pieces 166 and 170 so that the panel 136 abuts the panels 128 and 144 as illustrated in FIG. 10. The panel 134 of FIG. 9 is glued to the interior face of the wood piece 164 so that the panel 134 abuts the panels 126 and 142. The panel 132 is glued to the interior surface of the panel 122 on the perimeter formed inside the placement of the wood piece 164 and abuts panels 124 and 140.

The panel 188 is glued to the exterior face of the wood piece 168 and to the ends of the wood pieces 166 and 170 so that panel 188 abuts the panels 130 and 146 of FIG. 9. The panel 186 is glued to the bottom face of the wood piece 168 and to the bottom faces of the ends of wood pieces 166 and 170 so that the panel 186 abuts the panels 128 and 144 as illustrated in FIG. 10. The panel 184 of FIG. 9 is glued to the interior face of the wood piece 168 so that the panel 184 abuts the panels 126 and 142. The panel 132 is glued to the interior surface of the panel 122 on the perimeter formed inside the placement of the wood piece 168 and abuts panels 124 and 140.

A kraft, single-wall fiberboard sheet 152 is glued to all available interior surfaces of the panel 122 and to the exposed surfaces of the panels 124, 132, 140 and 182, as illustrated in FIGS. 9 and 10. An edge bead of adhesive 160 is also applied to the sheet 152 so that sheet 152 is glued to the panels 126, 134, 142 and 184. The sheet 152 is longitudinally corrugated (see corrugation lines 152*a* in FIG. 10) to provide additional strength and to prevent warping of the lid 150. When in place, as illustrated in FIG. 10, the sheet 152 completes a quad-wall construction of the lid 150.

Further referring to FIG. 10, metal striker plate 156 and metal thumb latch 158 are attached with metal screws 154 to the wood piece 170 through the die-cut holes 148 (FIG. 9) in the panel 144. The combination of the striker plate 156 and the thumb latch 158 catches and releases the striker 100 (FIG. 5). This forms the latching and unlatching mechanism for the lid 150.

Referring to FIG. 7, hinges 26 (46) are scored sheets of single-wall corrugated fiberboard. One portion 26*a* of each corrugated fiberboard hinge 26 (46) is glued to the panels 128 (FIG. 10) of lid 150. The lid 150 is attached to the casket body 50 by gluing the other portion 26*b* of the corrugated hinges 26 (46) of FIG. 7 to the panels 96 of side wraps 90 (FIG. 8) of the casket body 50 (see FIGS. 5 and 11). In the full-lid embodiment of FIGS. 1 and 2, four hinges are attached to the lid. In the split-lid embodiment of FIGS. 3 and 4, two hinges are attached to each lid. In should be noted that, in other respects, the construction of the full lid is identical to the construction of each split lid.

While preferred forms and arrangements have been shown in illustrating the invention, it is to be understood that various changes and modifications may be made without departing from the spirit and scope of this disclosure.

What is claimed is:

1. A flat lid for a casket, said flat lid comprising:

a pair of elongate side members forming separated sides of said flat lid;

a pair of elongate end members forming separated ends of said flat lid, each of said elongate end members extending between and being connected to respective ends of said elongate side members;

a flat cover extending between said elongate side members and said elongate end members, and covering respective top surfaces of said elongate side members and said elongate end members, said flat cover having four peripheral portions, each of said four peripheral portions extending around top, bottom and side surfaces of a respective one of said elongate end and side members and being fixed to a bottom surface of said flat cover; and a flat sheet disposed on and indirect contact with said bottom surface of said flat cover and extending between said elongate end and side members;

wherein said flat cover has corrugation extending in a first direction and said flat sheet has corrugation extending in a second direction perpendicular to said first direction.

2. The flat lid of claim 1, wherein each of said four peripheral portions includes a panel fixed to an exterior vertical side surface of a respective one of said elongate end and side members.

3. The flat lid of claim 1, wherein each of said four peripheral portions includes a panel fixed to the bottom surface of a respective one of said elongate end and side members.

4. The flat lid of claim 1, wherein said of said four peripheral portions includes a panel fixed to an inside vertical side surface of a respective one of said elongate end and side members.

5. The flat lid of claim 1, wherein each of said four peripheral portions includes a panel fixed to said bottom surface of said flat cover.

6. The flat lid of claim 1, further comprising a plurality of corrugated fiberboard hinges connected to one of said elongate side members for connecting said flat lid to said casket.

* * * * *